United States Patent [19]

Guttman

[11] 4,397,487

[45] Aug. 9, 1983

[54] FREE-WHEELING LATCHING SYSTEM

[76] Inventor: Milton Guttman, 1719 NE. Miami Gardens Dr., Apt. 230, North Miami Beach, Fla. 33179

[21] Appl. No.: 182,100

[22] Filed: Aug. 28, 1980

[51] Int. Cl.[3] ..... E05C 3/04

[52] U.S. Cl. ..... 292/202

[58] Field of Search ..... 292/63, 67, 202, 206, 292/212, 216; 49/402; 5/451

[56] References Cited

U.S. PATENT DOCUMENTS

| | | | |
|---|---|---|---|
| 1,334,610 | 3/1920 | Hope et al. | 292/202 |
| 1,433,430 | 10/1922 | Taylor | 292/212 |
| 1,795,502 | 3/1931 | Porell | 292/202 X |

FOREIGN PATENT DOCUMENTS

| | | | |
|---|---|---|---|
| 168066 | 6/1934 | Sweden | 292/202 |
| 105943 | 5/1917 | United Kingdom | 292/67 |
| 294948 | 7/1928 | United Kingdom | 292/202 |

*Primary Examiner*—Richard E. Moore

*Attorney, Agent, or Firm*—Finnegan, Henderson, Farabow, Garrett & Dunner

[57] ABSTRACT

A free-wheeling latching mechanism for securing a removable closure frame to a second closure frame includes a latching plate rotatable on a shaft fixed to, and spaced from, the second frame by a flange integrally formed on the shaft. A cap nut is used to retain the latching plate on the shaft during rotation, while providing spacing from the flange, and a sill attached to the second frame is used to support the removable frame during rotation of the latching plate.

7 Claims, 6 Drawing Figures

FREE-WHEELING LATCHING SYSTEM

BACKGROUND OF THE INVENTION

1. Field of the Invention

The present invention pertains to latching mechanisms for securing a removable closure frame, such as a window screen, against a second relatively fixed closure frame, such as a window frame or a door frame, particularly a window unit of the louver type.

2. Description of the Prior Art

It is well-known in the prior art to have window and door systems wherein the window or door closure frame accepts removable closure frames holding screening material or glass. The removable closure frames typically are positioned in the window or door frame and latching mechanisms are activated to secure the removable closure frame against the fixed closure frame. Such systems, of course, allow for the convenient replacement of glassed windows and doors with screening material during periods of warm weather and vice versa during colder months of the year.

It is conventional to secure the removable closure frames to the closure frame of the door or window using plate elements held eccentrically by screws or bolts installed concurrently with the replaceable closure frame. The screws or bolts are tightened sufficiently to produce a "wedging" or "clamping" force on the edge of the removable closure frame. Prior art latching systems are known wherein eccentric latching plates fixed to shafts are rotatably mounted on the closure frame, to be activated to a locking position by rotation of the shaft element relative to the frame.

Problems with latching mechanisms utilizing removable screws and latching plates are self-evident. An individual latching component can be dropped and become lost during installation, thereby causing undue delay or the use of less than a satisfactory number of latches due to the unavailability of a replacement part. The problems associated with latching mechanisms having latching plates fixed to shafts rotating within the closure frame include binding of the shaft in the frame, thus rendering the latch inoperable, or requiring an inordinate amount of effort to latch, and can lead to frustration an even injury of the installer and increased costs during normal maintenance procedures such as window cleaning. This problem is particularly prevelant in the use of aluminum closure frames and aluminum bolt materials which are susceptible to both galling and corrosion due to the weather.

SUMMARY OF THE INVENTION

The latching system of the present invention solves the various problems of prior art latching mechanisms in that it remains attached to the window or door closure frame at all times and provides "free-wheeling" rotation of the member used to capture the removable closure frame.

In accordance with the present invention, as embodied and broadly described herein, the apparatus of the free-wheeling latching system for securing a removable, first closure frame in a second closure frame, wherein the edge of the first frame extends perpendicularly an overhang distance beyond the edge of the second frame, comprises (a) a shaft non-rotatably attached to the second frame and extending perpendicular to the edge of the second frame; (b) an elongated latching plate having an eccentrically positioned aperture sized for free-wheeling rotation of the plate on the shaft; (c) means for spacing the latching plate from the first frame to allow rotation of the latching plate past the edge of the first frame to a position wherein the first frame is captured between the plate and the second frame; and (d) means for retaining the latching plate on the shaft during rotation of the plate.

Preferably, the apparatus further includes means for stopping further rotation of the latching plate when the capture position has been reached, and wherein the stopping means includes a lip formed on a longitudinal edge of the latching plate for abutting the extended first frame edge at the capture position.

It is also preferred that the spacing means of the free-wheeling latching apparatus includes a flange formed integrally with the shaft, wherein the flange has a first annular bearing surface facing one planar side of the latching plate and wherein the retaining means includes a retaining member having a second annular bearing surface facing the other planar side of the latching plate, and wherein the retaining means includes means for spacing the second annular bearing surface from the first annular bearing surface a distance greater than the thickness of the latching plate.

And it also preferred that, wherein the second closure frame is vertically disposed, the apparatus of the free-wheeling latching system includes means for aligning and supporting the first frame during rotation of the latching plate to the capture position, the aligning and supporting means including a sill member attached to the bottom of the second frame.

The accompanying drawing which is incorporated in and constitutes a part of this specification, illustrates one embodiment of the invention and, together with the description, serves to explain the principles of the invention.

DESCRIPTION OF THE PREFERRED EMBODIMENT

Figure 1:
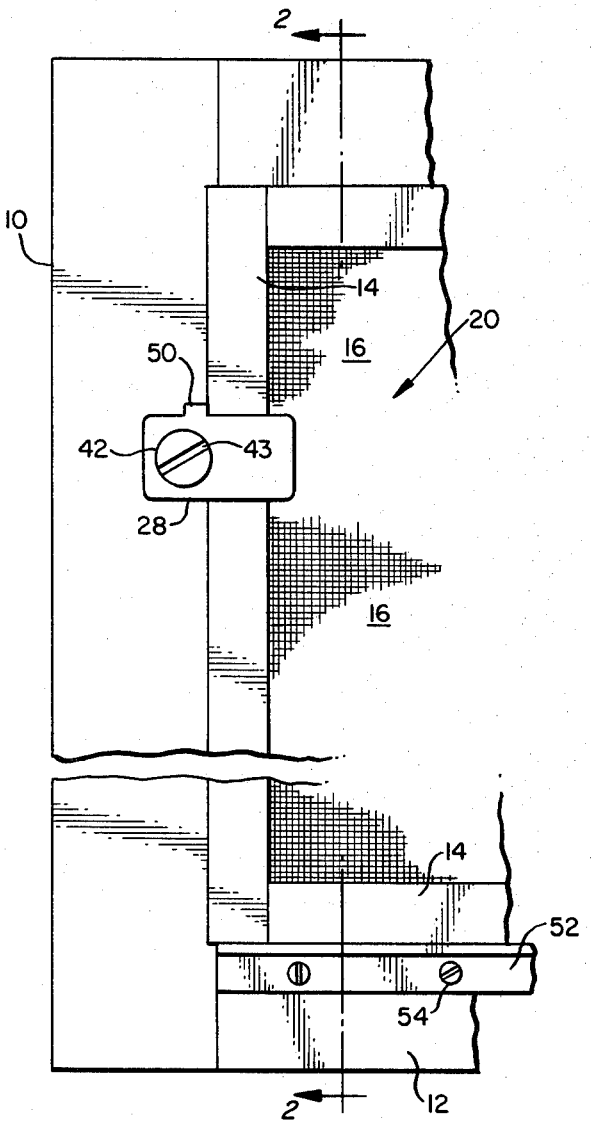
FIG. 1 is a schematic of the free-wheeling latching mechanism of the present invention shown securing a removable closure frame to a second, relatively fixed closure frame.

The free-wheeling latching system of the present invention is highly useful for securing removable closure frames against a second, relatively fixed closure frame, such as a window or a door frame. FIG. 1 shows a preinstalled window frame 10 having a lower frame member 12 to which a separate and removable closure frame 14 is to be secured. Closure frame 14 is depicted in FIG. 1 as holding screen material 16 but any other suitable planar material including glass can be used in place of the screen. Likewise, closure frame 10 can be a door frame or similar structural component.

Typically, several of the free-wheeling latching mechanisms of the present invention, designated generally as 20 in the figures, will be required to adequately secure frame 14 to frame 10. Only a single mechanism will be described, however.

In accordance with the present invention, free-wheeling latching mechanism 20 includes shaft 22 non-rotatably attached to frame 10 and extending perpendicular to the plane of frame 10. As embodied herein, shaft 22 has a self-tapping end 24 for screwing into hole 26 which is provided in frame 10. One of ordinary skill in the art would immediately realize that other means (not shown) could be used for securing shaft 22 to frame 10, such as a nut to receive the threaded end 24 or a self-tapping nut used in conjunction with a shaft having an unthreaded portion corresponding to portion 24.

In accordance with the invention, and as embodied herein, an elongated latching plate 28 is provided with aperture 30 positioned eccentrically for mounting on shaft 22. Aperture 30 is sized to provide free-wheeling rotation of plate 28 on shaft 22, and plate 28 can be made from any number of known materials such as sheet steel, aluminum, etc., and by conventional forming techniques, such as metal stamping. Plate 28 should be of a thickness to provide adequate stiffness in the longitudinal direction to capture and hold frame 14 against frame 10, as will be explained hereinafter.

Also in accordance with the present invention, the free-wheeling latching mechanism includes means for spacing plate 28 away from frame 10. Frames 10 and 14 are typically constructed such that when secured, the edge of frame 14 extends a short distance from the plane of frame 10 in the perpendicular direction. The resulting "overhang" distance 32 in FIG. 2 requires that plate 28 be spaced from frame 10 during rotation in order to preclude interference with the edge of frame 14.

Figure 5:
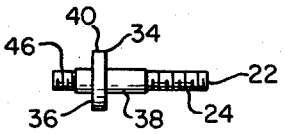
Figure 6A:
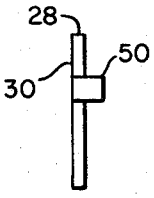
Figure 6B:
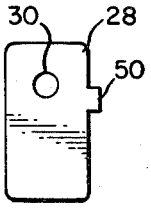

As embodied herein, and as best seen in FIG. 5, flange 34 is formed integrally with shaft 22 and has an annular bearing surface 36 against which plate 28 can rotate. The materials for shaft 22 and plate 28 should be chosen or treated to preclude excessive galling and friction. Flange 34 is shown having portions 38 and 40 of different diameters. The diameter of portion 38 should be sufficient to provide a stop for shaft 22 against frame 10, while the diameter of portion 40 generally will be larger to provide a larger corresponding annular bearing surface 36.

Figure 3:
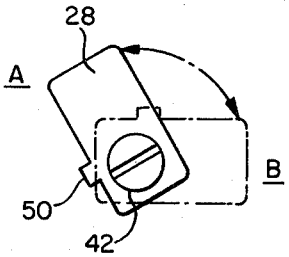
FIG. 3–6 are schematics showing the details of parts of the inventions shown in FIG. 1.
Figure 4:
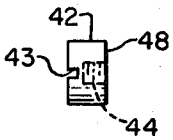

In accordance with the present invention, means are also provided for retaining latch plate 28 on shaft 22 during free-wheeling rotation of plate 28 from a frame removal position designated A (See FIG. 3) to a frame capture position designated B. As embodied herein, and as best seen in FIG. 4, the retaining means includes cap nut 42 having a threaded length 44. Shaft 22 is provided with a corresponding threaded end 46 for receiving cap nut 42. Alternatively, cap nut 42 can be self-threading and the end 46 of shaft 22 can be smooth. It is preferred in either case that cap nut 42 be self-locking to prevent loosening during rotation of plate 28. Cap nut 42 has an annular bearing surface 48 which faces the side of plate 28 opposite the annular bearing surface 36 of flange 34.

It is preferred that the threaded portion of cap nut 42 be sized to cause the annular bearing surface 48 to be spaced from annular bearing surface 36 a distance greater than the thickness of plate 28 to allow uninhibited rotation of plate 28 on shaft 22. The precise spacing will depend upon the dimensions of the various components but can be readily determined by those of ordinary skill in the art. The cap end of cap nut 42 can have slot 43 to facilitate the initial assembly of the latching mechanism.

Preferably, means are provided to stop further rotation of plate 28 once capture position B has been reached during installation of frame 14 on frame 10. As embodied herein, wherein frame 14 overhangs frame 10 a distance 32, a lip 50 is formed on a longitudinal edge of latching plate 28 to abutt the extended edge of frame 14 when the capture position has been reached. Lip 50 conveniently can be formed during fabrication of plate 28, such as by simple deformation if plate 28 is produced by metal stamping techniques.

Figure 2:
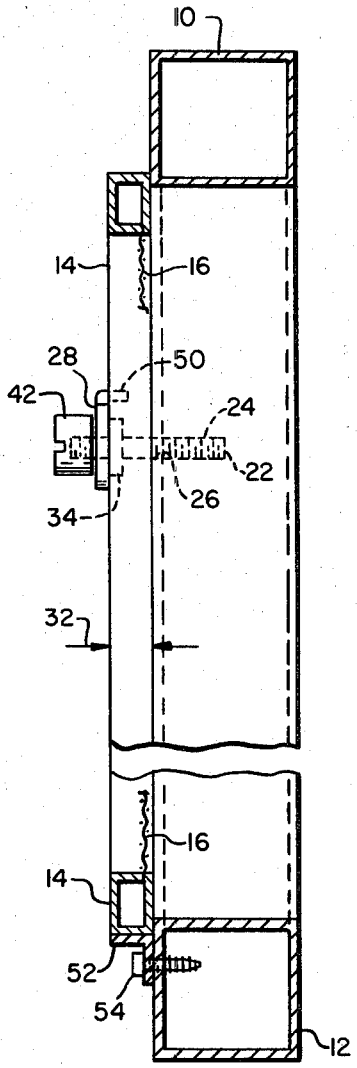
FIG. 2 is a cutaway view of the invention depicted in FIG. 1 along lines 2—2.

It is also preferred that the free-wheeling latching mechanism of the present invention also include means for aligning and supporting frame 14 during rotation of plate 28 from removal position A to capture position B, when frame 10 is vertically disposed. As embodied herein, the aligning and supporting means includes sill member 52 fixed to the bottom member 12 of frame 10. Sill 52 extends a perpendicular distance greater than or equal to the overhang distance 32 to provide positive support without incurring gravity-induced forces tending to tip frame 14, such as could occur if sill 52 extended a distance less than the overhang distance 32. Sill 52 can be attached to frame member 12 in any convenient manner, such as by self-tapping screws 54 which are shown in FIGS. 1 and 2.

It will be apparent to those skilled in the art that various modifications and variations could be made in the free-wheeling latching mechanisms of the present invention without departing from the scope or spirit of invention.

What is claimed is:

1. Apparatus for securing a removable, first closure frame in a second closure frame, wherein the edge of the first frame extends perpendicularly an overhang distance beyond the edge of the second frame, the apparatus comprising:

(a) a shaft non-rotatably attached to said second frame and extending perpendicular to the edge of said second frame; said second frame being vertically disposed;

(b) an elongated latching plate having an eccentrically positioned aperture sized for free-wheeling rotation of said plate on said shaft;

(c) means for spacing said latching plate from said first frame to allow rotation of said latching plate from said first frame to allow rotation of said latching plate past the edge of the first frame to a position wherein the first frame is captured between said plate and the second frame;

(d) means for retaining said latching plate on said shaft during said free-wheeling rotation of said plate; and (e) means for aligning and supporting the first frame during rotation of said latching plate to said capture position.

2. The apparatus as in claim 1 wherein said aligning and supporting means includes a sill member attached to the bottom of the second frame and sized to extend perpendicularly at least said overhang distance.

3. The apparatus as in claim 1 further including means for stopping further rotation of said latching plate when said capture position has been reached.

4. The apparatus as in claim 3 wherein said stopping means includes a lip formed on a longitudinal edge of the latching plate for abutting said extended first frame edge at said capture position.

5. The apparatus as in claim 1 wherein said spacing means includes a flange formed integrally with said shaft.

6. The apparatus as in claim 5 wherein the flange has a first annular bearing surface facing one planar side of said latching plate and wherein said retaining means includes a retaining member having a second annular bearing surface facing the other planar side of said latching plate, and wherein said retaining means includes means for spacing said second annular bearing surface from said first annular bearing surface a distance greater than the thickness of said latching plate.

7. The apparatus as in claim 6 wherein the end of said shaft distant the closure frame is threaded and wherein said retaining means includes a cap nut.

* * * * *